United States Patent [19]

Meinzer

[11] 4,138,093

[45] Feb. 6, 1979

[54] GUARD RAIL CELL

[76] Inventor: Lester N. Meinzer, 4331 Sierra Madre Dr., Sacramento, Calif. 95825

[21] Appl. No.: 797,924

[22] Filed: May 18, 1977

[51] Int. Cl.[2] ..... A01K 3/00

[52] U.S. Cl. ..... 256/13.1; 188/1 C

[58] Field of Search ..... 256/13.1, 19, 1; 238/10; 248/66; 188/1 C

[56] References Cited

U.S. PATENT DOCUMENTS

| | | | |
|---|---|---|---|
| 3,493,213 | 2/1970 | Ackerman | 256/13.1 |
| 3,666,055 | 5/1972 | Walker et al. | 256/13.1 |
| 3,784,167 | 1/1974 | Glaesener | 256/13.1 |
| 3,982,734 | 9/1976 | Walker | 256/13.1 |
| 4,062,521 | 12/1977 | Moreau | 256/13.1 |

*Primary Examiner*—Ronald Feldbaum

*Attorney, Agent, or Firm*—Blair, Brown & Kreten

[57] ABSTRACT

Disclosed herein is a cell used preferably with a guard rail to absorb the impact of a vehicle which crashes into the rail. The cell converts the kinetic energy of the automobile and absorbs it by distortion of the cell. The effect of the cushion is that it redirects the vehicle back to the roadway without causing severe damage to the vehicle guard rail or posts.

6 Claims, 4 Drawing Figures

GUARD RAIL CELL

BACKGROUND OF THE INVENTION

FIELD OF THE INVENTION

As insurance rates rise, so to has the effort to reduce damage to property and personnel on the highway by providing guard rails which have deformable cell portions which absorb energy and direct the automobiles back onto the roadway, the magnitude of the damage done to passengers and property can be minimized.

It is therefore an object of this invention to provide a means for transforming automobile kinetic energy by deforming a guard rail cell or a plurality of them, and thereby redirecting the car so as to keep it on the roadway.

It is a further object of this invention to provide a guard rail cell which is capable of easy replacement upon deformation, and at a low cost.

These and other objects will become apparent when considering the appended drawings and specification.

DESCRIPTION OF THE PREFERRED EMBODIMENT

Figure 1:
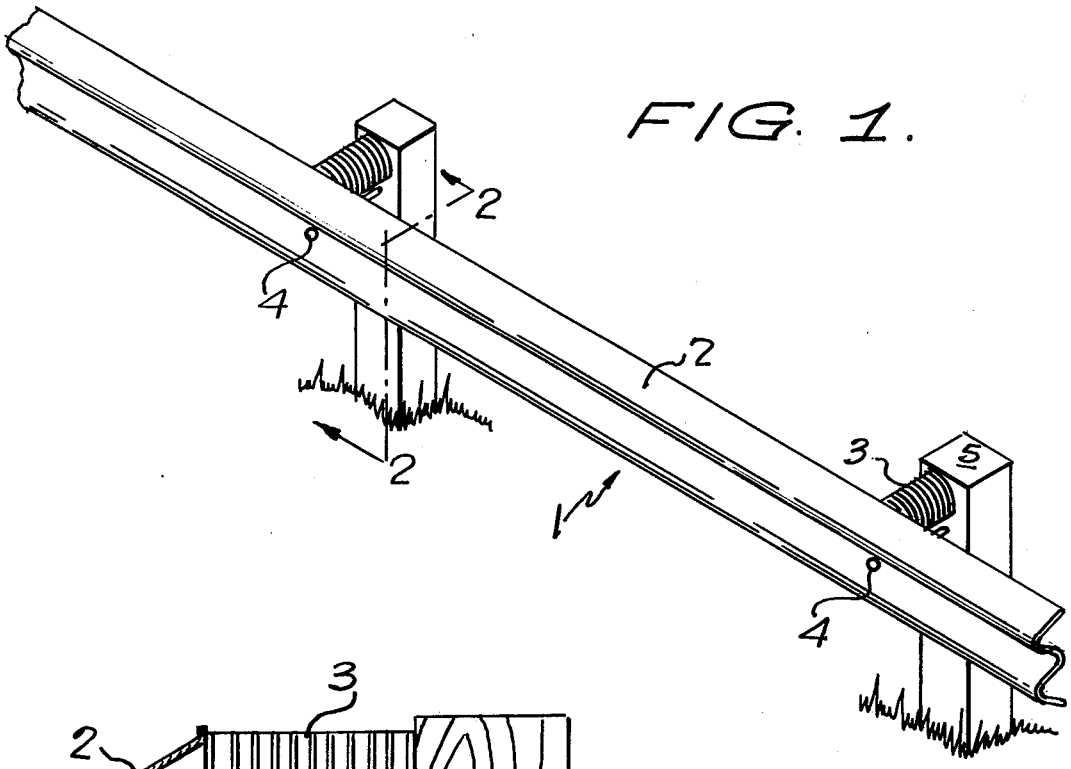
FIG. 1 shows a three quarter perspective view of the invention including guard rail and post.
Figure 2:
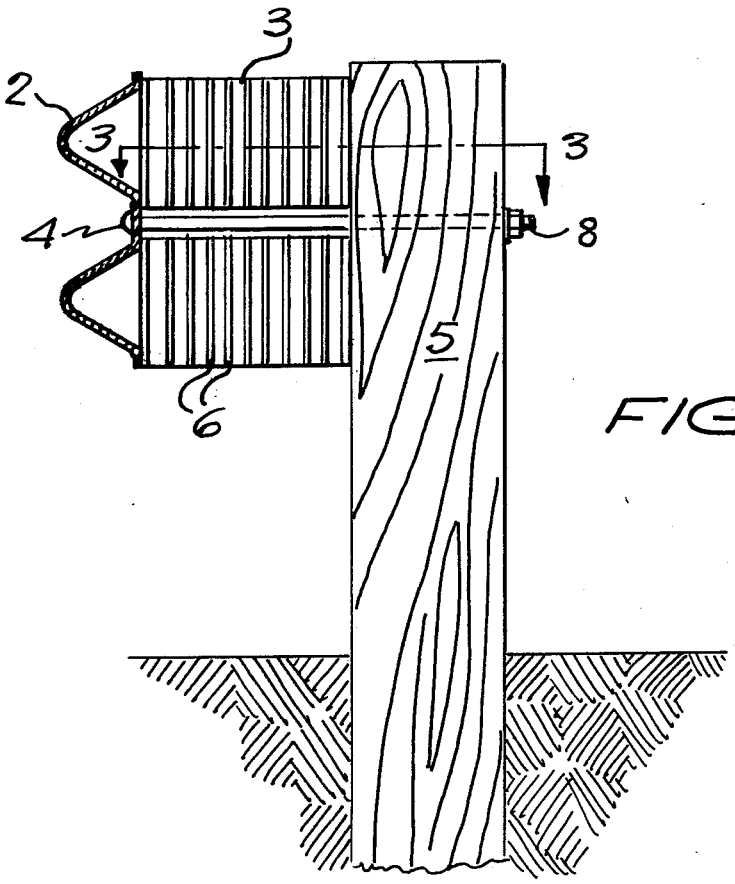
FIG. 2 shows a sectional view taken along the lines 2—2 of FIG. 1.

Referring now to the drawings, in which similar reference numerals in the drawings refer to like parts throughout, the overall guard rail system is generally denoted by numeral 1.

The guard rail assembly comprises a rail member 2 carried by a post member 5 and cell member 3 which are attached by a bolt 4. The guard rail 2 generally has a W-shaped configuration and is supported by cell 3 and bolt 4. Cell 3 is of substantially cylindrical configuration, and has grooves 6 disposed on its outer circumference. The cell 3 is carried by post 5 which may be made of wood or any other material which is well known in the art.

Figure 3:
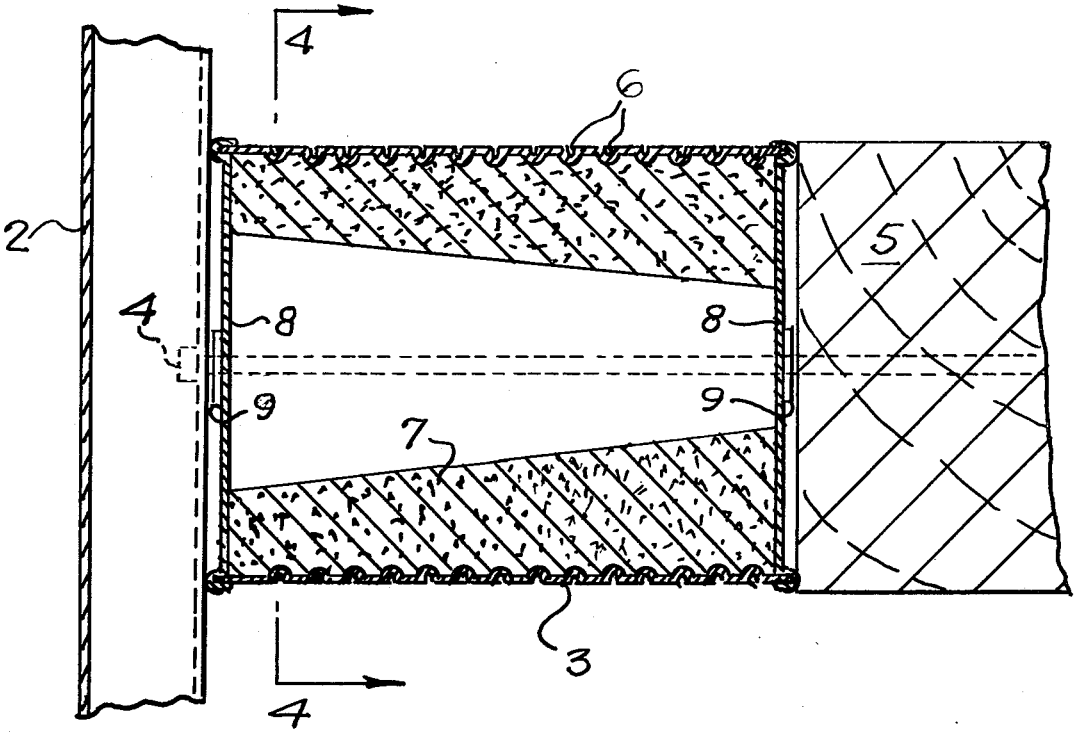
FIG. 3 shows a sectional view of the structure shown in FIG. 2 looking downward along the lines 3—3 of FIG. 2.
Figure 4:
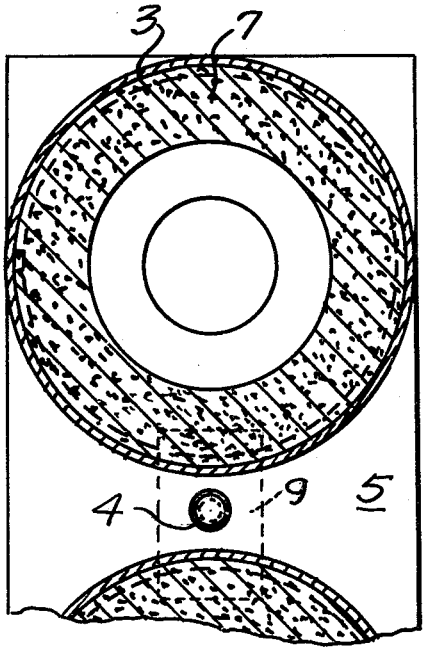
FIG. 4 shows a further sectional view of the cell looking along the lines 4—4 of FIG. 3.

FIG. 3 best depicts damping capabilities of the cell, and disposed within the cell is a conical void. This conical void is truncated at its extremities defined by the inner walls 8 of the cell member. Extending outwardly from this truncated conical void and terminating on the inner wall portion of the cell is the energy absorbing material or cushion 7.

The bolts 4 connect the rail 2 to the post 5 extending between a pair of cells 3 and supports the cells 3 by passing through brackets 9 attached to opposite ends of adjacent cells 3.

The outer wall or housing defined by numeral 3 preferably made from tin, such as a number 10 tin can, and the inner cushion or damping material is preferably formed of a cenentious material which has been expanded with vermiculite particules.

An alternative embodiment, and one which has different properties then that which has been discussed above, would embrace a cylindrical void in the center of the cell rather than a conical one. A cylindrical void would be useful for example when a higher force was anticipated in the deformation of the cell, and could be used for example on a highway having higher speeds which would therefore require greater damping in the cell member. The tapered cylinder however would start to crush with less pressure than the straight cylinder.

Another means for varying the energy absorbtion capabilities of the cell is in the formulation of the damping material 7. The cement is preferably made from approximately 50% portland cement and 50% casting plaster, and it is combined with the vermiculite particles. The particles of vermiculite are preferably one quarter to one thirty second of an inch in diameter. Using the example of a number 10 tin can which is 6 inches in diameter and 7 inches long, a damping compound using 6 pounds portland cement and 6 pounds of casting plaster to each cubic foot of expanded vermiculite combined with sufficient water to make a workable mix will provide an adequate and desirable damping compound formulation. The damping material fills approximately two thirds of the space in the can and after compression the outer dimension of the can will have been reduced to 2 inches in length. Therefore the 33% space allocated towards the void is necessary to provide space for the crushed material and the deformation of the cell without having the can break its seams.

The damping compound is placed in the can, and then dehydrated to remove moisture. A suitable mold is utilized to provide the contour of the inner void as desired and specified above. After the moisture has been removed a vacuum is applied to the can and the can is then sealed.

Upon impact, the vacuum stabilizes and pulls the sides inward, and causes the can walls to wrinkle inward as the can decreases in length, thereby producing a well defined collapsed container of solid material. This compaction is assisted not only by the vacuum maintained within the cell, but also by the ribs 6 which are circumferentially disposed about the cell member. These ribs encourage clean and neat folds as the can decreases in length.

As stated above the aggregate mix of vermiculite preferably has particle size of a quarter to a thirty second of an inch and when crushed will reduce the particle size by perhaps 80%. Other sizes can be considered but only at the expense of the compression range and resistance needed for this energy disposing cell.

The vacuum which is applied and maintained in the can provides the additional benefit when the compression has been applied. The walls of the cell will be pulled inwardly fairly evenly. Without evacuation of the cell seam rupture is increased and outward dispersion of the damping material is more likely. This would result in a smaller damping action for a given cell size.

The conical shape of the void on the inside of the can encourages distortion of the cell structure upon impact as seen in FIG. 3 from left to right. When the cell has been crushed to its limit the resulting structure will be a can of perhaps one third the original size having the damping material displaced to the right hand portion of the cell with associated distortion. Having the conical configuration provides a large crush distance to can length ratio and promotes progressive crushing of material rather than disintegration all at one time.

Having thus described the preferred embodiment of the invention it should be understood that numerous structural modifications and adaptations may be re-sorted to without departing from the spirit of the invention.

What is claimed is:

1. A guard rail system comprising a support post, a guard rail member attached to said post and a cell member attached between said guard rail and said post, said cell member comprising a cylindrical metallic container having circumferentially disposed ribs thereon, damping material disposed on the inner periphery of the container, in such a manner to provide a truncated conical void at the core of said container, so that upon compression the larger portion of the conical void is closest to the guard rail member and resistances increases upon continued deformation and the ribs encourage linear deformation of the container rather than a rupture.

2. The guard rail assembly of claim 1 wherein said void is under a vacuum.

3. The guard rail cell member of claim 2 in which said damping composition comprises cement, plaster and vermiculite.

4. The guard rail cell member of claim 3 in which the ratio of cement to plaster is 50—50 and in which 6 pounds of cement and 6 pounds of plaster is provided for each cubic foot of vermiculite.

5. The rail cell member of claim 4 in which the vermiculite aggregate has a particle size of approximately one quarter to one thirty second of an inch.

6. The guard rail cell member of claim 5 in which the void occupies one third of the total volume of the cell.

* * * * *